United States Patent [19]

McQuary

[11] 4,266,780

[45] May 12, 1981

[54] TARGET WITH HIT COUNTER

[75] Inventor: Kenneth L. McQuary, Lawndale, Calif.

[73] Assignee: Placo Products Company, Torrance, Calif.

[21] Appl. No.: 93,907

[22] Filed: Nov. 13, 1979

[51] Int. Cl.[3] ..... F41J 5/00

[52] U.S. Cl. ..... 273/387; 235/121; 273/392

[58] Field of Search ..... 273/387, 392, 127 D; 235/112, 118, 120, 121

[56] References Cited

U.S. PATENT DOCUMENTS

| | | | |
|---|---|---|---|
| 2,631,780 | 3/1953 | Branner | 235/121 X |
| 3,376,039 | 4/1968 | Fenton . | |
| 3,784,201 | 1/1974 | Wyman et al. . | |
| 3,785,552 | 1/1974 | Payne, Jr. . | |

FOREIGN PATENT DOCUMENTS

| | | | |
|---|---|---|---|
| 459592 | 9/1913 | France | 273/387 |

*Primary Examiner*—Anton O. Oechsle

[57] ABSTRACT

A target with hit counter including a ratchet wheel rotatably mounted in a housing, and a target member pivotally mounted in the housing, with said member having a pawl for rotating the ratchet wheel a predetermined amount in a forward direction. The housing includes a second pawl mounted thereon for preventing reverse rotation of the ratchet wheel. The apparatus includes an element for biasing the target member toward the ratchet wheel, and a pointer fastened to the rotatable ratchet for indicating a score on a scoring board.

7 Claims, 4 Drawing Figures

TARGET WITH HIT COUNTER

BACKGROUND OF THE INVENTION

This invention relates to targets having a means for counting hits, and is particularly there intended for use in conjunction with toy dart guns.

In the past, there have been many different games involving a target having a score keeping element, which is rotated step-by-step in response to successive hits. Such devices use various structures wherein a target, when hit, causes rotation of another element.

For example, the patent to Fenton, U.S. Pat. No. 3,376,039, discloses a photocell target with an indexed target disc in which a "hit" indicator is coupled to a Geneva mechanism and advanced to indicate another hit each time the photocell is energized. Another example is that shown in the patent to Wyman et al, U.S. Pat. No. 3,784,201. It discloses a rotatably scoring dart board having darts which, when thrown, attach to the target and thus tend to turn the target about its rotational axis by an amount which is a function of the radial and angular position of the dart on the target. Another score keeping device, disclosed in the patent to Payne, Jr., U.S. Pat. No. 3,785,552, is actuated by a hockey puck as it travels from a simulated cage to cause a spring powered dial to turn one increment indicative of the new score.

Difficulties have been encountered with conventional hit counting devices such as those due mainly to the complexity of such devices. The presence of numerous electrical connections, gears, belts, etc., makes such devices relatively expensive to manufacture and assemble, and decreases reliability and durability of the devices. Furthermore, depending on the type of target used it may be important that the device merely count hits of the target, and not necessarily reflect accuracy of the hit in terms of proximity from the center of the target. In addition it is important that such a device increase a score by one increment per hit, and not be permitted to decrease the score by having the score indicator operate in a reverse direction.

Therefore, it is an object of the present invention to construct a new and improved target with hit counter which is simple, efficient, and inexpensive to construct. It is a further object of the present invention to provide a hit counter which counts successive hits of the target by turning one increment for each hit. Another object is to proved a hit counter that is reliable and durable.

SUMMARY OF THE INVENTION

The target with hit counter of the present invention includes a housing, a ratchet wheel rotatably mounted in the housing, a target member pivotally mounted in the housing having a pawl for rotating the ratchet wheel incrementally in a forward direction, a means for preventing reverse rotation of the ratchet wheel, and in the preferred embodiment, a score indicating means. The means for preventing reverse rotation of the ratchet wheel preferably includes a pawl mounted on the housing. The biasing element preferably comprises a coil spring positioned between the target arm and the housing, and returns the target element to its upright ready position. The score indicating means may comprise a pointer fastened to the shaft of the ratchet wheel, and an adjacent scoring board portion having an incremental scoring scale thereon.

DESCRIPTION OF THE PREFERRED EMBODIMENT

The target with hit counter 10 has a board portion 12 and target member 14. The board portion has an incremental scoring scale 16 on its face shown as numbers 1–10 uniformly spaced and arranged in circular fashion.

Figure 2:
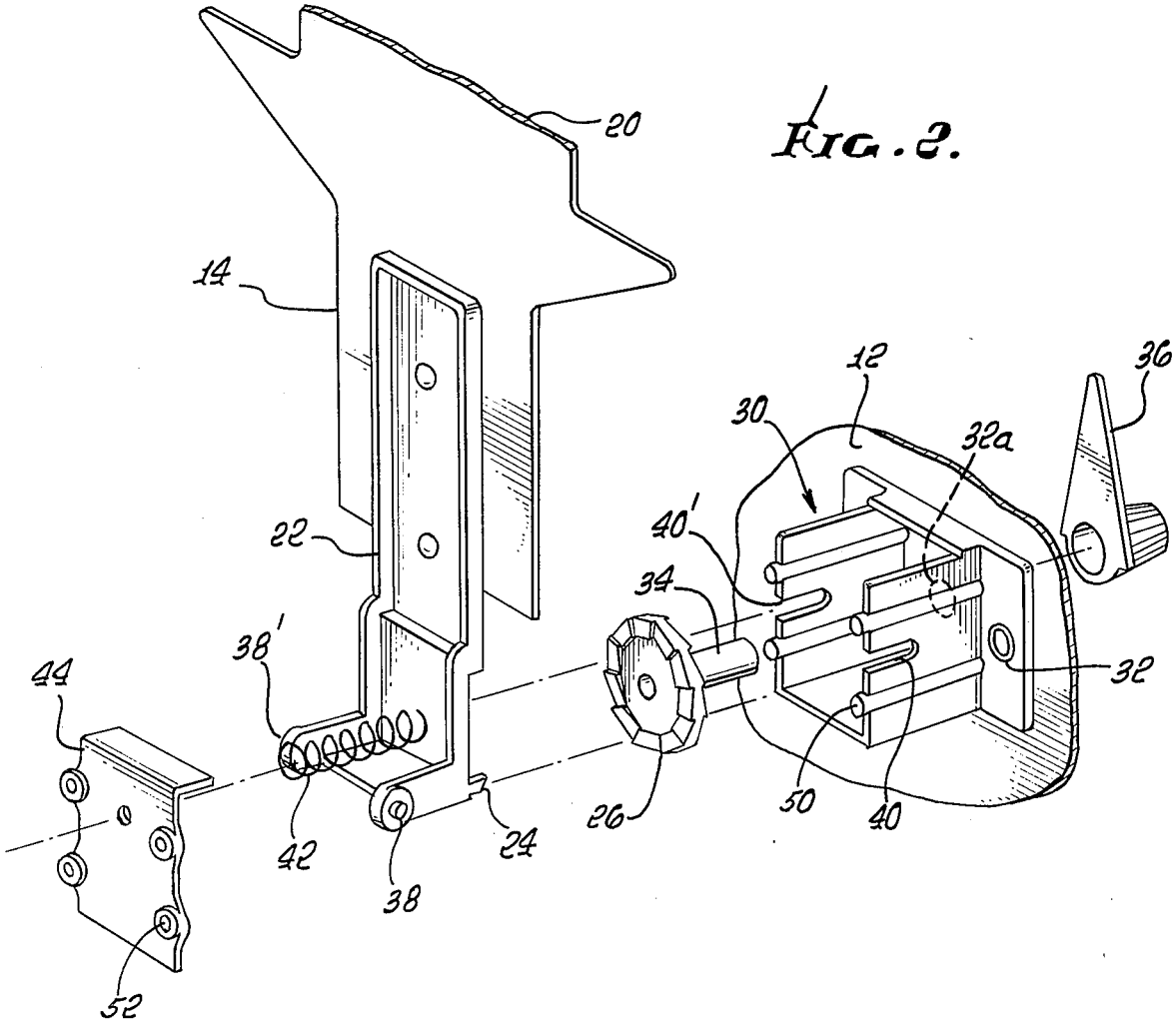
FIG. 2 is a rear exploded view of the preferred embodiment illustrating disassembled components.

Referring to FIG. 2, target member 14 may have a target portion 20 fastened to target member arm 22 as shown, or may be constructed of one piece. The target member has a pawl 24 for engagement with ratchet wheel 26. The ratchet wheel has a shaft portion 34. A housing 30 is attached by means of rivets 32 to scoring board 12. A hole **32*a* in the base of the housing receives shaft 34 of the ratchet wheel 26**.

The ratchet wheel is rotatably mounted through the hole **32*a* and held in place by pointer 36. Target member arm 22 is pivotally mounted in housing 30 with pivots 38,38' seating in slots 40,40' of the housing. A biasing element 42, such as a coil spring, is positioned between the target member and a housing cover 44 for biasing target member against the ratchet wheel. For ease of assembly, the housing is provided with mounting pins 50 to which mounting holes 52** of the housing cover are mated to secure the cover.

Figure 3:
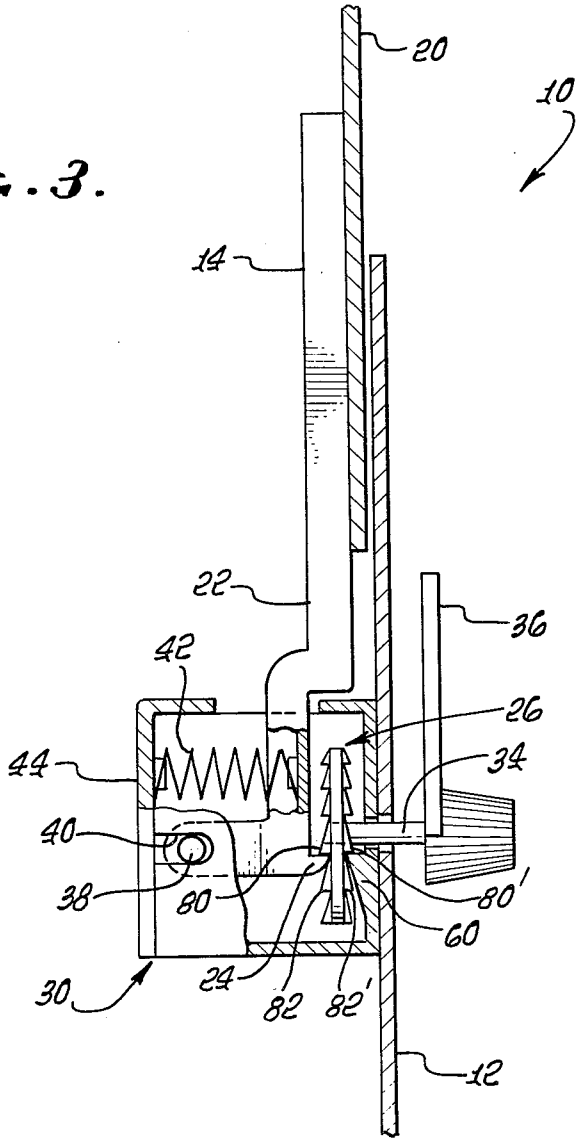
FIG. 3 is an enlarged partial sectional view taken along line 3—3 of FIG. 1, showing the device before a hit.

The unit is shown at rest in FIG. 3, with target member 14 in a upright vertical or ready position. Pawl 24 of the target arm engages a ratchet tooth 80 on ratchet wheel 26. Another pawl 60 is positioned opposite pawl 24 on the other side of ratchet wheel 26 engaging ratchet tooth 80' for preventing reverse rotation of the ratchet wheel.

Figure 1:
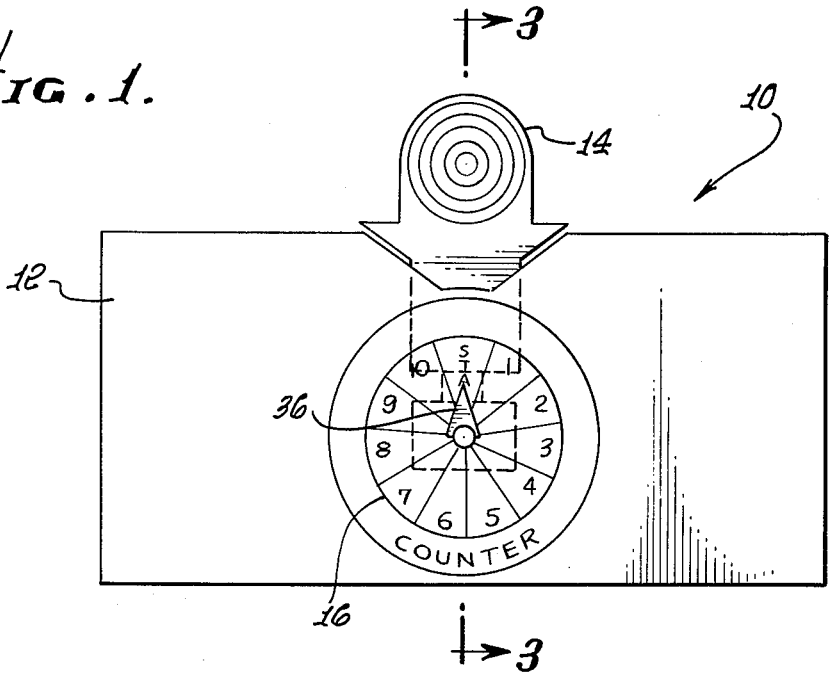
FIG. 1 is a front view of a target with hit counter incorporating the presently preferred embodiment of the invention.
Figure 4:
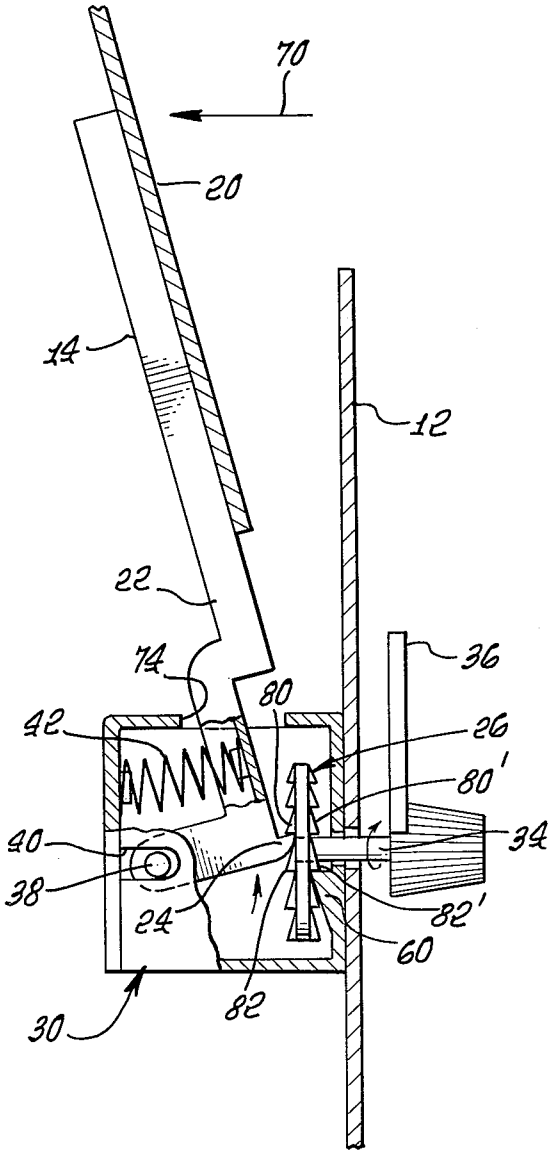
FIG. 4 is a sectional view similar to FIG. 3, showing the device immediately after a hit.

In operation, when target member 14 is hit by a dart or other projectile in a direction as shown by line 70 of FIG. 4, target member 14 is thrust back and pawl 24, engaging ratchet wheel 62, rotates the ratchet wheel shaft forward, in this instance clockwise, as viewed in FIG. 1, causing pointer 36 to rotate accordingly. Target member 14 is prevented from further backward rocking movement by engagement with the surface 74 of cover 44, and rotation of the ratchet wheel ceases. At this point the pointer has been advanced one number or increment on the scoring scale. It should be noted that the number of uniform increments on the scoring scale preferably corresponds to the number of ratchet teeth on the ratchet wheel.

The target member is then returned to its original upright ready position by expansion of now compressed spring 42. As the target member returns to its upright position, pawl 24 moves away from ratchet tooth 80, riding across the inclined top of the next ratchet tooth 82. This riding motion tends to cause the ratchet wheel to rotate in a reverse direction. However, pawl 60 now engages ratchet tooth 82' preventing any reverse rotation of the ratchet wheel as the target member returns to its upright position. Thus with each successive hit of the target member, the pointer is advanced one increment in a forward direction, counting and indicating the number of hits on the scoring scale.

The shaft 34 slides or translates along its axis of rotation in the hole 32*a* as the shaft is rotated, the translation being produced by engagement of a tooth 82' with the pawl 60. The pivots 38,38' of arm 22 slide in the slots 40,40', respectively, when the arm is pivoted from the position of FIG. 3 to that of FIG. 4, due to movement of the point of engagement of the pawl 24 and wheel 26. Preferably the slot 40 is deeper than the slot 40', permitting forward movement of the pivot 38 and pawl 24 and pivoting of the arm about a vertical axis, to maintain the pawl 24 in engagement with the wheel 26 throughout the cycle of operation.

The spring 42 serves several functions: it urges the arm 22 to the upright position of FIG. 3; it maintains a load on the wheel 26 and shaft 34 so there is no looseness or play in the mechanism; it urges the wheel 26 against the pawl 60 so there is no rotation in the reverse direction; and it maintains the pawl 24 in engagement with the wheel 26, preferably by the pivoting of the arm 22.

I claim:

1. A target with a rotating shaft output for driving a hit counter and comprising:

a housing;

a ratchet wheel having a shaft rotatably mounted in said housing, said ratchet wheel having opposite faces with a first set of pawl engaging teeth on one face and a second set of pawl engaging teeth on the opposite face;

a target member pivotally mounted in said housing for movement between first and second positions, said member having a pawl carried by and pivoting with said member for engaging said first set of teeth of said ratchet wheel for advancing said wheel in a forward direction;

means for preventing reverse rotation of said ratchet wheel comprising another pawl mounted on said housing and engaging said second set of teeth of said ratchet wheel; and bias means for biasing said target member toward said first position.

2. An apparatus as defined in claim 1 including score indicating means having a pointer carried by said ratchet shaft, and a scoring board carried on said housing and having an incremental scoring scale.

3. An apparatus as defined in claim 2 wherein said bias means includes a coil spring positioned between said target member and said housing.

4. An apparatus as defined in claim 3 wherein said target member pawl engages said ratchet wheel to advance said wheel when said target member is pivoted from said first to said second position.

5. A target with a rotating shaft output for driving a hit counter and comprising:

a housing;

a ratchet wheel having a shaft rotatably mounted in said housing, with said ratchet wheel shaft mounted for translation in said housing along the axis of rotation of said shaft;

a target member pivotally mounted in said housing for movement between first and second positions, said member having a pawl for engaging said ratchet wheel for advancing said wheel in a forward direction, with said target member mounted in said housing for translation in the direction of said shaft axis of rotation;

means for preventing reverse rotation of said ratchet wheel; and bias means for biasing said target member toward said first position, with said bias means also biasing said target member pawl into engagement with said ratchet wheel and said ratchet wheel into engagement with said means for preventing reverse rotation.

6. An apparatus as defined in claim 5 wherein said means for preventing reverse rotation is a second pawl mounted on said housing opposite said target member pawl and said ratchet wheel has ratchets on opposite faces thereof.

7. An apparatus as defined in claim 5 including means defining interengaging slots and pivots at said target member and housing, with a first slot adjacent said target member pawl and a second slot remote therefrom, and with said slots permitting said translation of said target member, with said first slot extending closer to said ratchet wheel than said second slot, whereby said bias means can produce a pivoting of said target member about an axis generally perpendicular to said axis of rotation as said apparatus is activated to count a hit.

* * * * *